US005325556A

United States Patent [19]

Stewart, Jr. et al.

[11] Patent Number: 5,325,556

[45] Date of Patent: Jul. 5, 1994

[54] METHOD AND APPARATUS FOR MEASURING THE POSITION OF A DYE DEFLECTOR BLADE

[75] Inventors: William H. Stewart, Jr., Campobello; Charles A. Wethington, Pauline; Jerry E. Bode, Green, all of S.C.

[73] Assignee: Milliken Research Corporation, Spartanburg, S.C.

[21] Appl. No.: 88,502

[22] Filed: Jul. 7, 1993

[51] Int. Cl.[5] ..... D06B 1/02

[52] U.S. Cl. ..... 8/151; 68/205 R; 118/314

[58] Field of Search ..... 68/205 R; 118/314, 315; 8/151

[56] References Cited

U.S. PATENT DOCUMENTS

| | | | |
|---|---|---|---|
| 3,393,411 | 7/1968 | McElveen | 8/151 |
| 3,683,649 | 8/1972 | Takriti et al. | 68/5 D |
| 3,688,530 | 9/1972 | Harris et al. | 68/205 R |
| 3,731,503 | 5/1973 | Appenzeller et al. | 68/205 R |
| 3,892,109 | 7/1975 | Klein et al. | 68/205 R |
| 3,894,413 | 7/1975 | Johnson | 68/205 R |
| 3,937,045 | 2/1976 | Klein et al. | 68/205 R |
| 3,939,675 | 2/1976 | Klein | 68/205 R |
| 3,942,342 | 3/1976 | Klein et al. | 68/205 R |
| 3,942,343 | 3/1976 | Klein | 68/205 R |
| 3,969,779 | 7/1976 | Stewart, Jr. | 8/149 |
| 3,985,006 | 10/1976 | Klein | 68/205 R |
| 4,019,352 | 4/1977 | McCollough, Jr. et al. | 68/205 R |
| 4,033,154 | 7/1977 | Johnson | 68/205 R |
| 4,034,584 | 7/1977 | Klein et al. | 68/205 R |
| 4,055,868 | 11/1977 | O'Neill, Jr. | 8/150 |
| 4,058,991 | 11/1977 | McCollough | 68/205 R |
| 4,059,880 | 11/1977 | Klein | 29/157 C |
| 4,095,444 | 6/1978 | Pascoe, Sr. et al. | 68/205 R |
| 4,097,946 | 7/1978 | McCollough | 8/150 |
| 4,116,626 | 9/1978 | Varner | 8/149 |
| 4,148,668 | 4/1979 | Stewart, Jr. | 134/22 C |
| 4,433,811 | 2/1984 | Godfrey | 239/74 |
| 4,434,632 | 3/1984 | McCollough, Jr. et al. | 68/205 R |
| 4,648,250 | 3/1987 | Yabe | 68/5 D |

FOREIGN PATENT DOCUMENTS

| | | |
|---|---|---|
| 0061176 | 3/1982 | European Pat. Off. . |
| 978452 | 5/1962 | United Kingdom . |
| 1201598 | 5/1969 | United Kingdom . |

*Primary Examiner*—Philip R. Coe

*Attorney, Agent, or Firm*—Kevin M. Kercher; Terry T. Moyer

[57] ABSTRACT

The present invention is directed to an apparatus and process for precisely measuring the position of a deflector blade. When patterned dyeing a moving textile web wherein continuously flowing streams of liquid normally directed in paths to impinge upon the web are selectively deflected from contact with the web in accordance with pattern information then each continuously flowing liquid stream is selectively deflected by a stream of air which is discharged, in accordance with pattern information, from an air outlet located adjacent each liquid discharge outlet. The air outlet is positioned to direct the air stream into intersecting relation with the liquid stream and to deflect the liquid into a collection chamber or trough for recirculation. To accurately control the amount of dye applied to a given location on the material during the dyeing operation, and to insure that the dye strikes the material in a very small, precise spot, the lower portion of the collection chamber contains a deflector blade supportably positioned in spaced relation above the lower wall of the collection chamber and wherein means are provided for accurately measuring the position of the deflector blade to facilitate accurate placement of the dye streams on the moving material during the printing process and precise interception of the streams when deflected.

16 Claims, 8 Drawing Sheets

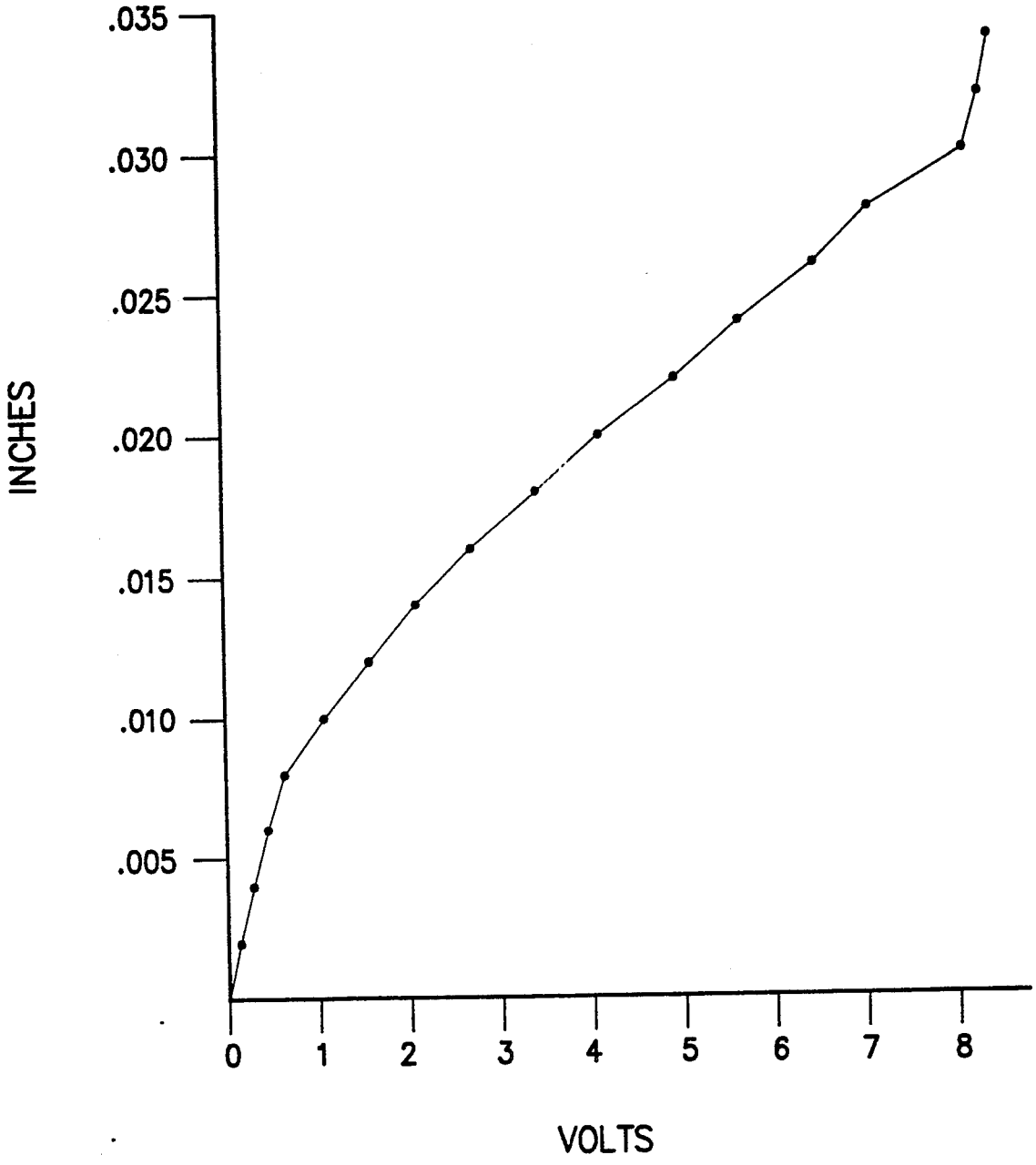
*FIG. —14—*

METHOD AND APPARATUS FOR MEASURING THE POSITION OF A DYE DEFLECTOR BLADE

BACKGROUND OF THE INVENTION

It is known to apply liquids such as dyes to moving textile materials from plural streams which are directed onto the materials and selectively controlled to produce a desired pattern thereon. McElveen U.S. Pat. No. 3,393,411 describes apparatus and process wherein plural streams of liquid are selectively controlled in their flow to provide a distinct pattern on pile carpet.

U.S. Pat. Nos. 3,443,878 and 3,570,275 describe apparatus and process for the patterned dyeing of a moving textile web wherein continuously flowing streams of liquid normally directed in paths to impinge upon the web are selectively deflected from contact with the web in accordance with pattern information. The webs are thus dyed in a desired pattern and the deflected dye is collected and recirculated for use. Each continuously flowing liquid stream is selectively deflected by a stream of air which is discharged, in accordance with pattern information, from an air outlet located adjacent each liquid discharge outlet. The air outlet is positioned to direct the air stream into intersecting relation with the liquid stream and to deflect the liquid into a collection chamber or trough for recirculation. To control accurately the amount of dye applied to a given location on the material during the dyeing operation, and to insure that the dye strikes the material in a very small, precise spot, the lower portion of the collection chamber contains a deflector blade supportably positioned in spaced relation above the lower wall of the collection chamber. This deflector blade is adjustably attached to the lower wall so that its edge can be accurately positioned relative the dye discharge axes of a gun bar to insure prompt and precise interception of the streams when deflected. A gunbar is defined as a plurality of dye jets, arranged in spaced alignment, which extend generally above and across the width of a substrate to be treated. Details of such a dyeing apparatus and collection chamber are described and claimed in commonly assigned McCollough, Jr. et al., U.S. Pat. No. 4,019,352 issued Apr. 26, 1977 and hereby incorporated by reference.

It can be appreciated that in the application of different colored dyes to the surface of textile fabrics, it is extremely important to place each dyestuff on the fabric accurately, particularly when intricate patterns are being printed and when in situ blending is employed. Precise measurement of the position of the deflector blade with respect to the dye discharge axes of the gun bar is difficult because the deflector blade is thin and flexible, and thus will move if touched by a measuring device. Adjustment is made by looking at the edge of the deflector blade and an adjacent jet and moving the deflector blade edge to approximately one-half the width of a liquid discharge outlet diameter from the surface of the liquid stream. The next step would be to attempt to provide uniform application across the width of the textile fabric. Because these adjustments are approximate, this is normally nonuniform. A common reaction is to attempt realignment, these attempts are usually unsuccessful.

The present invention solves these problems and others in a manner not disclosed in the known prior art.

SUMMARY OF THE INVENTION

The present invention is directed to an apparatus and process for precisely measuring the position of a deflector blade. When pattern dyeing a moving textile web wherein continuously flowing streams of liquid normally directed in paths to impinge upon the web are selectively deflected from contact with the web in accordance with pattern information, from an air outlet located adjacent each liquid discharge outlet, the air outlet is positioned to direct the air stream into intersecting relation with the liquid stream and to deflect the liquid into a collection chamber or trough for recirculation. To accurately control the amount of dye applied to a given location on the material during the dyeing operation, and to insure that the dye strikes the material in a very small, precise spot, the lower portion of the collection chamber contains a deflector blade supportably positioned in spaced relation above the lower wall of the collection chamber and wherein means are provided for accurately measuring the position of the deflector blade to facilitate accurate placement of the dye streams on the moving material during the printing process and precise interception of the streams when deflected.

It is an advantage of this invention to provide a means for accurately measuring the position of the deflector blade without physical contact.

It is another advantage to be able to measure the position of the deflector blade within a few thousands of an inch.

These and other advantages will be in part obvious and in part pointed out below.

BRIEF DESCRIPTION OF THE DRAWINGS

The above as well as other advantages of the invention will become more apparent from the following detailed description of the preferred embodiments of the invention, which when taken together with the accompanying drawings, in which:

FIG. 14 is a graph representing deflector blade position versus voltage.

Corresponding reference characters indicate corresponding parts throughout the several views of the drawings.

DETAILED DESCRIPTION OF THE PREFERRED EMBODIMENT

Figure 1:
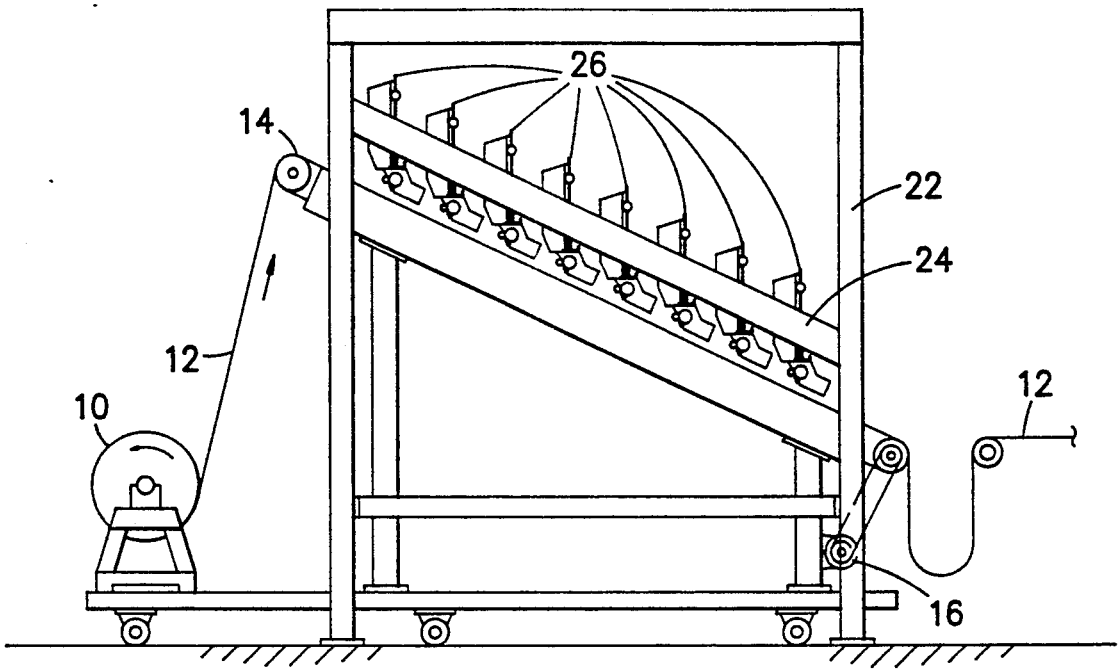
FIG. 1 represents a diagrammatic side view of the array configuration of a dyeing apparatus of a kind for which the instant invention may be adapted, depicting eight dye-emitting arrays positioned above a section of a substrate web to be patterned.

Referring now by reference numerals to the drawings and first to FIG. 1, it will be understood that FIG. 1 depicts, in a side elevational view, a set of eight individual arrays or liquid jet gun bars 26 positioned within frame 22. These liquid jet gun bars 26 form part of a pattern dyeing machine to which the present invention is particularly suited. Each liquid jet gun bar 26 is comprised of a plurality of dye jets, arranged in spaced alignment, which extend generally above and across the width of substrate 12 and are suitably supported at their ends by attachment to diagonal frame members (one of which, 24, is shown) on either side of the conveyor 14. Substrate 12 is supplied from roll 10 and is transported in turn under each liquid jet gun bar 26 by conveyor 14 driven by a suitable motor indicated generally at 16. After being transported under liquid jet gun bars 26, substrate 12 may be passed through other dyeing-related process steps such as drying, fixing, etc.

Figure 2:
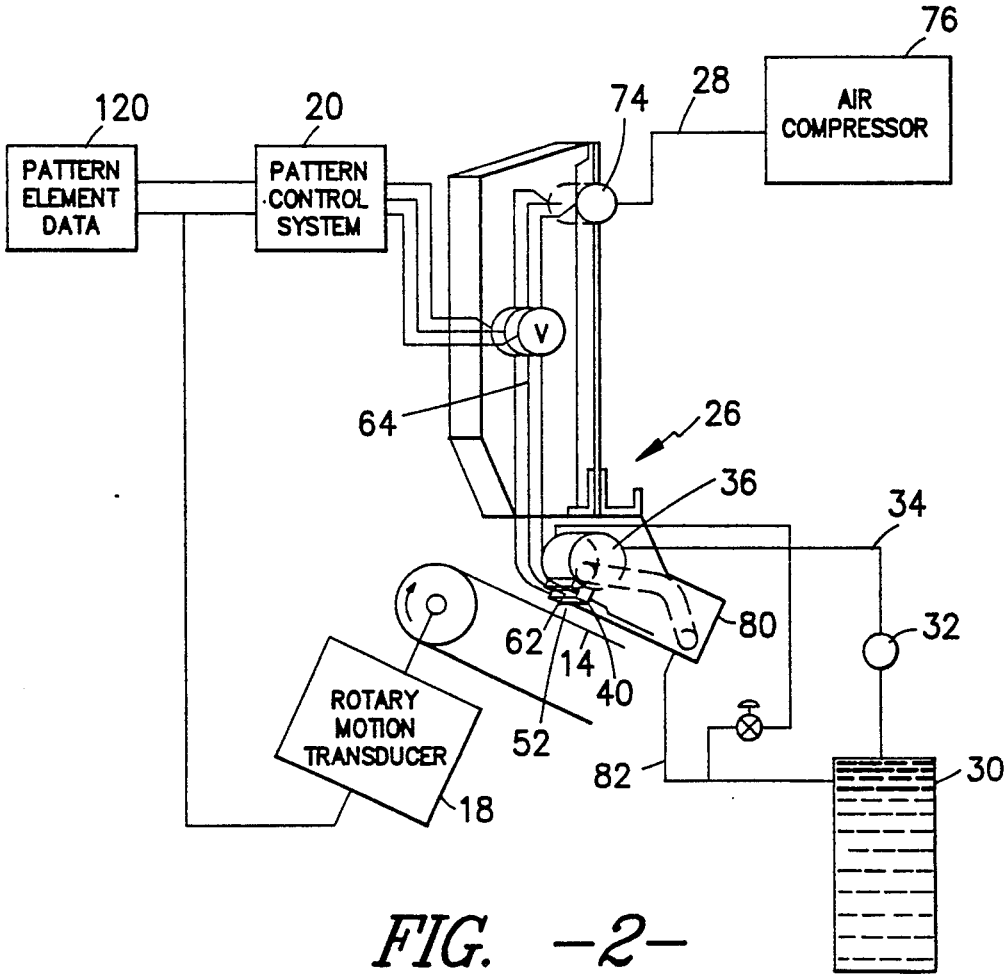
FIG. 2 represents a schematicized diagram of a portion of the apparatus of FIG. 1.

FIG. 2 depicts, in schematic form, a side elevation of one dye-emitting liquid jet gun bar of the machine of FIG. 1. For each liquid jet gun bar shown generally at 26, a separate dye reservoir tank 30 supplies liquid dye under pressure, by means of pump 32 and dye supply conduit means 34, to a primary manifold pipe assembly 36 of the liquid jet gun bar 26. This primary manifold pipe assembly 36 does not have to be cylindrical. Primary manifold pipe assembly 36 communicates with and supplies dye to dye sub-manifold assembly 40 at suitable locations along their respective lengths. Both primary manifold pipe assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 positioned across the width of conveyor 14 that produces a plurality of parallel dye streams that are directed onto the surface of the substrate 12 to be patterned.

As shown in FIG. 2, positioned in alignment with and approximately perpendicular to each dye passage outlet 52 in dye sub-manifold assembly 40 is the outlet of an air deflection tube 62. Each tube 62 communicates by way of an air supply conduit 64 with an individual air valve, illustrated collectively at "V", which valve selectively interrupts the flow of air to air deflection tube 62 in accordance with pattern information supplied by pattern control system 20. There is a pattern element data source that forms an integral part of a multiprocessor system 120 that sends information to the pattern control system 20. Each valve is, in turn, connected by an air supply conduit 28 to pressured air supplied by air compressor 76. Each of the valves V, which may be of the electromagnetic solenoid type, are individually controlled by electrical signals from a pattern control system 20. The outlets of air deflection tubes 62 direct streams of air that are aligned with and impinge against the continuously flowing streams of dye flowing from dye passage outlets 52 and deflect such dye streams into a collection chamber or trough 80, from which liquid dye may be removed by means of conduit 82 to dye reservoir tank 30 for recirculation.

The pattern control system 20 for operating solenoid valves V may be comprised of various pattern control means. The multiprocessor system 120 provides desired pattern element information to the pattern control system 20 to operate the solenoid valves V. The pattern information is transmitted at appropriate times in response to movement by conveyor 14 that is detected by suitable rotary motion sensor or transducer means 18 operatively associated with the conveyor 14 and connected to the pattern control system 20. Details of one means to perform this function may be found in commonly assigned U.S. Pat. No. 4,033,154, issued Jul. 5, 1977, which disclosure is hereby incorporated by reference.

In a typical dyeing operation utilizing such apparatus, so long as no pattern information is supplied by pattern control system 20 to the air valves V associated with the liquid jet gun bar of dye passage outlets 52, the valves remain "open" to permit passage of pressurized air from air manifold 74 through air supply conduits 64 to deflect continuously all of the continuously flowing dye streams from the dye passage outlets 52 into the collection chamber 80 for recirculation. When the substrate 12 initially passes beneath the dye passage outlets 52 of the individual liquid jet gun bars 26, pattern control system 20 is actuated in a suitable manner, such as manually by operator. Thereafter, signals from the rotary motion sensor 18 prompt pattern information from multiprocessor system 120. An example of a means of automatically and electronically changing from one pattern to another is disclosed in U.S. Pat. No. 4,170,883, issued Oct. 16, 1979, which is hereby incorporated by reference. As dictated by pattern information, pattern control system 20 generates control signals to selectively "close" appropriate air valves so that, in accordance with the desired pattern, deflecting air streams at specified individual dye passage outlets 52 along the liquid jet gun bars 26 are interrupted and the corresponding dye streams are not deflected, but instead are allowed to continue along their normal discharge paths to strike the substrate 12. Thus, by operating the solenoid air valves of each liquid jet gun bar in the desired pattern sequence, a colored pattern of dye is placed on the substrate 12 during its passage under the respective liquid jet gun bar 26.

Specific details regarding the construction of the gunbars are disclosed in coassigned U.S. Pat. No. 5,161,395, that issued on Nov. 10, 1992, which is incorporated by reference as if fully set forth herein and coassigned U.S. Pat. No. 5,159,824, that issued on Nov. 3, 1992, which is incorporated by reference as if fully set forth herein.

Figure 3:
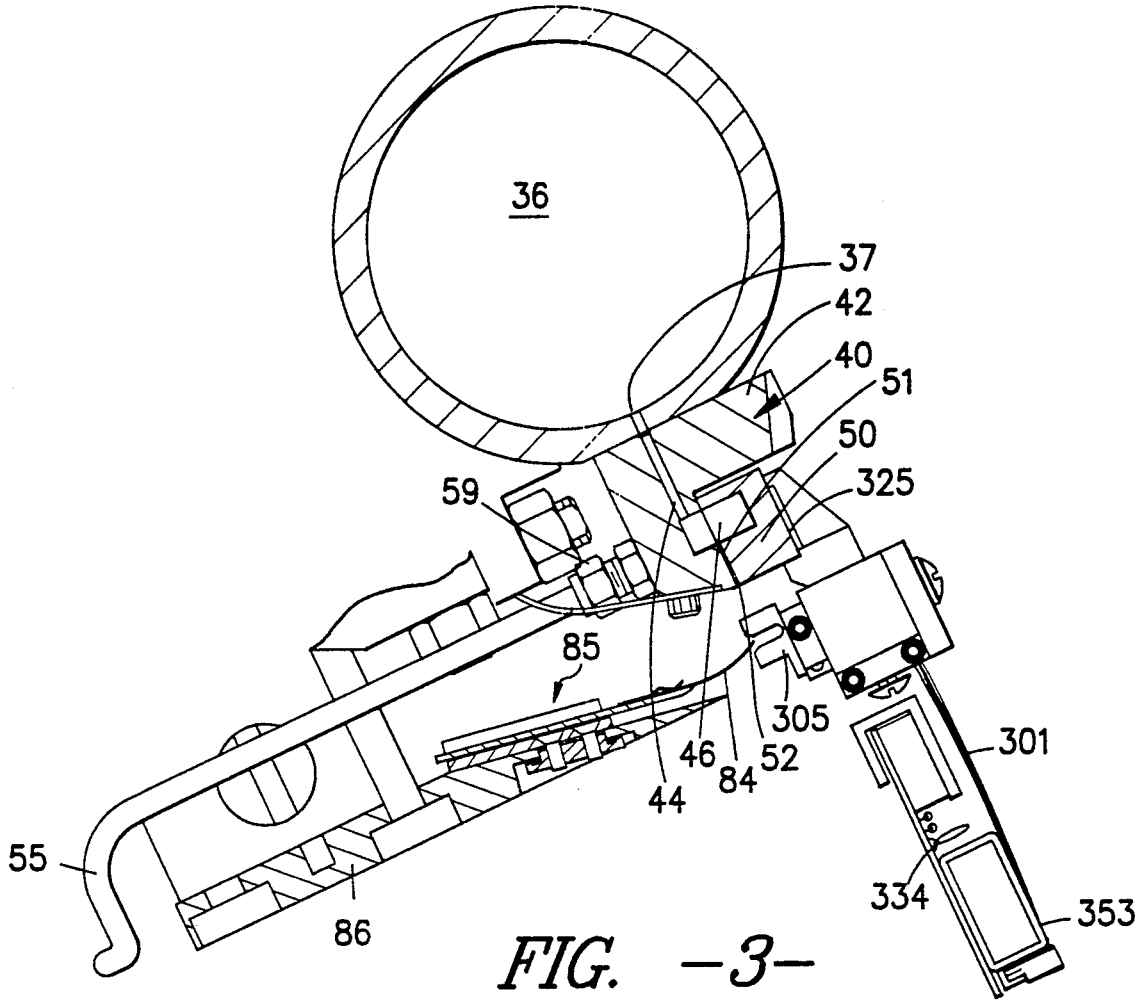
FIG. 3 is a fragmentary sectional side elevational view of a jet dye applicator detailing a primary dye deflector blade adjustment assembly including and opto-electric blade position sensor.

As depicted most clearly in FIG. 3, primary manifold pipe assembly 36 is comprised of a pipe having a flat mating surface that accommodates a corresponding mating surface on dye submanifold assembly 40. Sub-manifold assembly 40 is comprised of sub-manifold module section 42, grooved dye outlet module 50, and an elongate sub-manifold 46 cooperatively formed by elongate mating channels in sub-manifold module section 42 and grooved dye outlet module 50. Sub-manifold module section 42 is attached to primary manifold pipe assembly 36 by bolts (not shown) or other suitable means so that drilled outlet conduits 37 in the mating surface of primary manifold pipe assembly 36 and corresponding drilled passages 44 in the mating surface of elongate submanifold 46 are aligned, thereby permitting pressurized liquid dye to flow from the interior of manifold assembly to elongate sub-manifold 46.

Associated with the mating face of grooved dye outlet module 50 are a plurality of dye outlet module grooves or channels 51, that when grooved dye outlet module 50 is mated to sub-manifold section module 42 as by bolts or other appropriate means (not shown), to form dye passage outlets 52 through which uniform quantities of liquid dye from elongate sub-manifold 46 may be directed onto the substrate 12 in the form of aligned, parallel streams.

Associated with grooved dye outlet module 50 is deflecting air jet assembly (not shown) by which individual streams of air from air deflection tubes (not shown) may be selectively directed. When the liquid dye stream is deflected, the liquid dye exiting from dye passage outlets 52 is directed into primary dye collection chamber 80, shown in FIG. 2, which may be formed of suitable sheet material such as stainless steel and extends along the length of the liquid jet gun bar 26, however, any of wide variety of metal, plastic, composites, ceramics and so forth may suffice as throughout this Application. Associated with collection chamber 80 is the primary dye deflector blade 84 that is comprised of a thin flexible blade-like member that is positioned parallel and closely adjacent to the row of dye passage outlets 52, as shown in FIG. 3. Primary dye deflector blade 84 may be adjustably attached at spaced locations along its length by a primary dye deflector blade adjustment assembly apparatus 85, which will be fully described hereinafter, to a collector plate support member 86 that is both wedge-shaped and elongate, which forms an extension of the floor of collection chamber 80 and extends along the length of liquid jet gun bar 26. Primary dye deflector blade 84 may be mounted under tension along its length and aligned with the axes of dye outlet module grooves 51 as shown in FIGS. 3, 11 and 12.

There are also a plurality of primary high velocity bypass tubes 55 that divert fluid into the collection chamber 80. The tubes 55 attach by means of conventional hardware (i.e., tubing fittings) 59 to the sub-manifold module 42. The tubes can be constructed of metal, plastic, rubber, and so forth.

Figure 9:
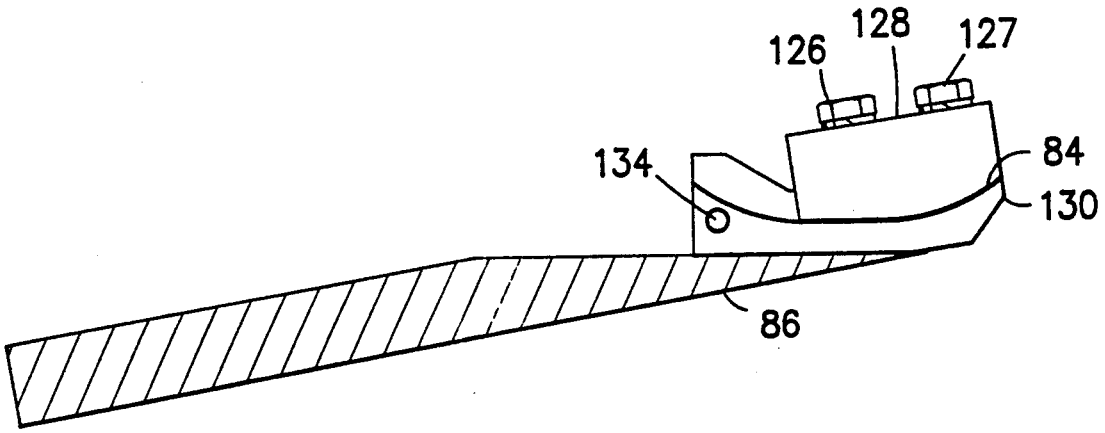
FIG. 9 is a sectional side elevational view taken on line 9—9 of FIG. 11.
Figure 10:
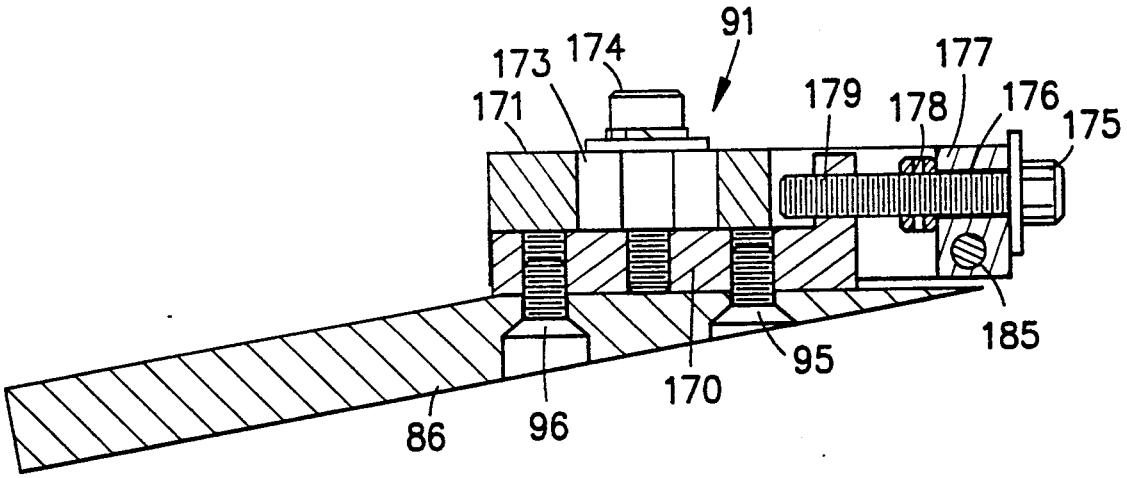
FIG. 10 is a sectional side elevational view taken on line 10—10 of FIG. 11.
Figure 11:
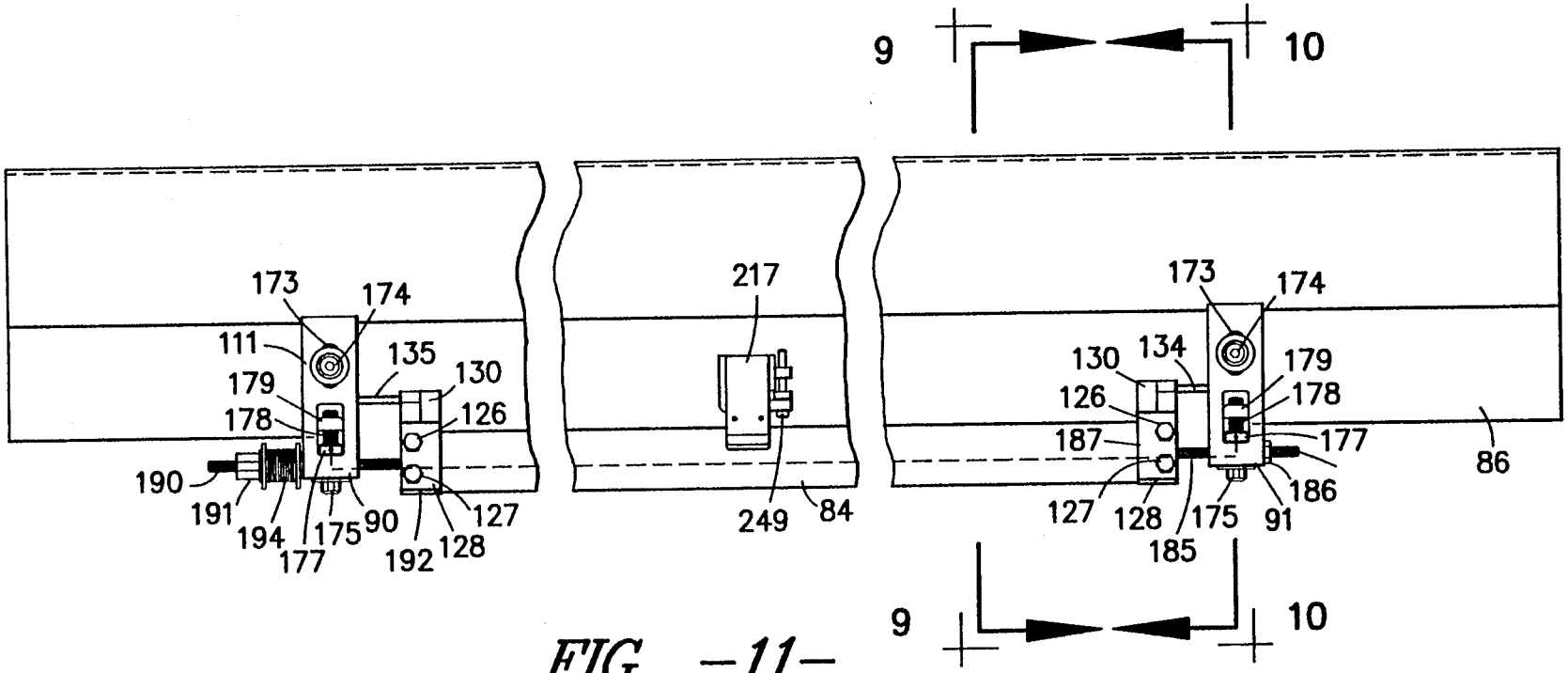
FIG. 11 is a fragmented top plan view of a collector plate support member with a primary dye deflector blade attached thereto by means of two end mount adjuster assemblies and a representative intermediate primary dye deflector blade adjustment assembly.
Figure 12:
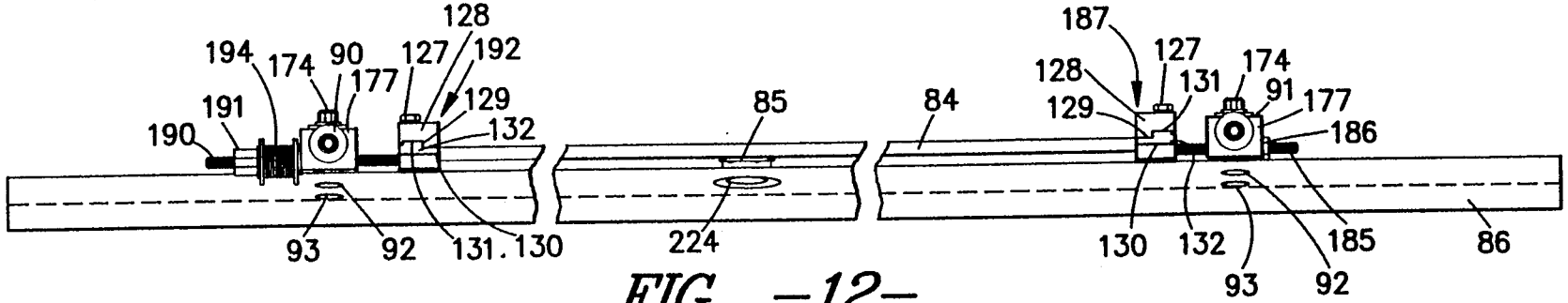
FIG. 12 is a front elevational view of a collector plate support member with a primary dye deflector blade attached thereto by means of two end mount adjuster assemblies and a representative intermediate primary dye deflector blade adjustment assembly.

The primary dye deflector blade adjustment assembly apparatus 85 is found in FIGS. 4, 5, 9, 10, 11 and 12. The ends of the primary dye deflector blade 84 are attached to the collector plate support member 86 by two end mount adjuster assemblies 90 and 91, respectively, as shown in FIGS. 11 and 12. Both end mount adjuster assembly 90 and end mount adjuster assembly 91 have substantially similar components and can be described by utilizing the same numerical designation. There are two access holes 92 and 93 in order to provide access to bolts 95 and 96 which attach each end mount adjuster assembly 90, 91 to collector plate support member 86 as shown in FIGS. 10 and 12.

Referring now to FIG. 10, bolts 95 and 96 are received by the bottom of L-shaped member 170 which is a subcomponent of either end mount adjuster assembly 90 or 91. There is a top plate member 171 which is moveable in a direction toward and away from the outer edge of the collector plate support member 86 by means of a bolt and washer combination 174 that is inserted through an oval opening 173 and threadedly connected to the L-shaped member 170. Movement of the top plate member 171 is accomplished by adjustment of a threaded bolt 175 that enters a through hole 176 in a vertical face segment 177 of the top plate member 171, is threadedly attached to a threaded nut 178, which is pinned to bolt 175 to fix the top plate member 171 in a specific location with reference to the collector plate support member 86. Threaded bolt 175 also is inserted in a through hole 179 of the smaller vertical segment of the L-shaped member 170. This configuration is the same for both end mount adjuster assembly 90 and 91, respectively. There is a threaded bolt 185 which is threaded through end mount adjuster assembly 91, and in particular, vertical face segment 177 as shown in FIGS. 11 and 12, and is then fixedly attached to a deflector blade holding mechanism 187. There is a nut 186 to provide adjustment and is located on the outside of the end mount adjuster assembly 91. At the other end of the primary dye deflector blade 84 is end mount adjuster assembly 90 having threaded bolt 190 which is analogous to threaded bolt 185, and is also threaded through vertical face segment 177 as shown in FIG. 11, and is then fixedly attached to a deflector blade holding mechanism 192 that is analogous to deflector blade holding mechanism 187. There is also a nut 191 similar to nut 186 to provide adjustment and is located on the outside of the end mount adjuster assembly 91. However, there is a stack of Belleville® springs 194 to exert around five hundred (500) pounds of tension on the primary dye deflector blade 84, as shown in FIGS. 11 and 12, that are located between the nut 191 and vertical face segment 177 of end mount adjuster assembly 90.

Deflector blade holding mechanism 192 is structured as a mirrored complement to deflector holding mechanism 187 so that subcomponents thereof will be designated identically. There is a top plate portion 128 having a rectangular notch 131 that engages a bottom plate portion 130 having corresponding rectangular ridge 132. The primary dye deflector blade 84 has each lateral side wrapped around a piece of wire 129 and held in position between the rectangular notch 131 and the rectangular ridge 132. There is a pair of bolts 126 and 127 respectively, to attach the top plate portion 128 to the bottom plate portion 130, as shown in FIGS. 9, 11 and 12. As shown in FIGS. 9 and 11, there is a slide member 134 in the form of a dowel rod that is press fitted into end mount adjuster assembly 91 and is inserted in a through hole in bottom plate portion 130 of defector blade holding mechanism 187. This provides horizontal stabilization for the primary dye deflector blade 84. There is another analogous slide member 135 in the form of a dowel rod that is press fitted into end mount adjuster assembly 90 and is inserted in a through hole in bottom plate portion 130 of defector blade holding mechanism 192 for the same purpose of stabilization.

Since the primary dye deflector blade 84 is subject to vibration, the preferred embodiment spaces several primary dye deflector blade adjustment assembly apparatus 85 along the length of the collector plate support member 86 to prevent movement of the primary dye deflector blade 84. The primary dye deflector blade adjustment assembly apparatus 85 is adjustable in a direction toward and away from the longitudinal edge of the collector plate support member 86 in a substantially perpendicular relationship.

Referring now to FIGS. 4, 5, 11 and 12, the primary dye deflector blade adjustment assembly apparatus 85 includes a rectangular adjuster arm 217 having a retaining clip 219 attached at one end by means of rivets 221, but any means of mechanical interconnection will suffice such as bolts, adhesives and so forth, as is typical throughout this Application. The retaining clip 219 holds the primary dye deflector blade 84 in place to prevent vibration. The rectangular adjuster arm 217 is held in position by a U-shaped channel member 214 on each side for movement of the entire rectangular adjuster arm 217. The U-shaped channel member 214 is attached to the collector plate support member 86. This U-shaped channel member 214 provides movement fore and aft substantially perpendicular to the longitudinal axis of the primary dye deflector blade 84 so that the primary dye deflector blade can move toward and away from the dye passage outlets 52.

Figure 4:
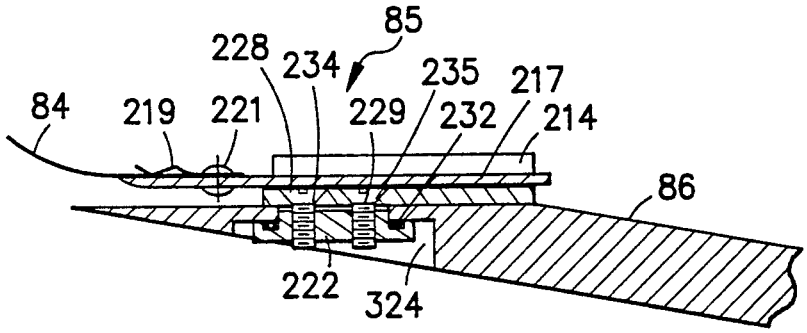
FIG. 4 is a side elevational view of a primary dye deflector blade adjustment assembly.

The U-shaped channel 214 is secured to the collector plate support member 86 by means of two flat head screws 228, 229, respectively that are threadedly attached to a round sealing disk 222, as shown in FIG. 4. The flat head screws 228, 229 penetrate through holes 234, 235 in the U-shaped channel member 224 that are tapered to prevent passage of the heads of the flat head screws 228, 229 that are designated by numerals 237 and 238, respectively. There is an O-ring 232 that seals the space between the round sealing disk 222 and the collector plate support member 86. As shown in FIGS. 4 and 12, there is access to the round sealing disk 222 by means of opening 224.

Figure 5:
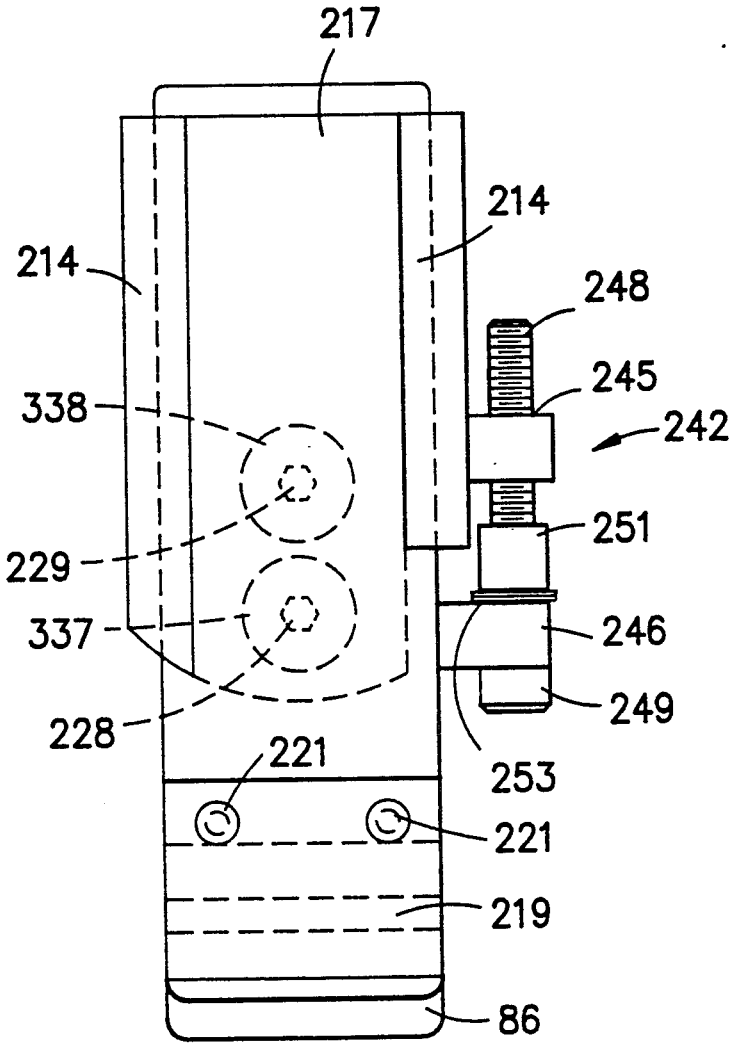
FIG. 5 is a top plan view of a primary dye deflector blade adjustment assembly.
Figure 6:
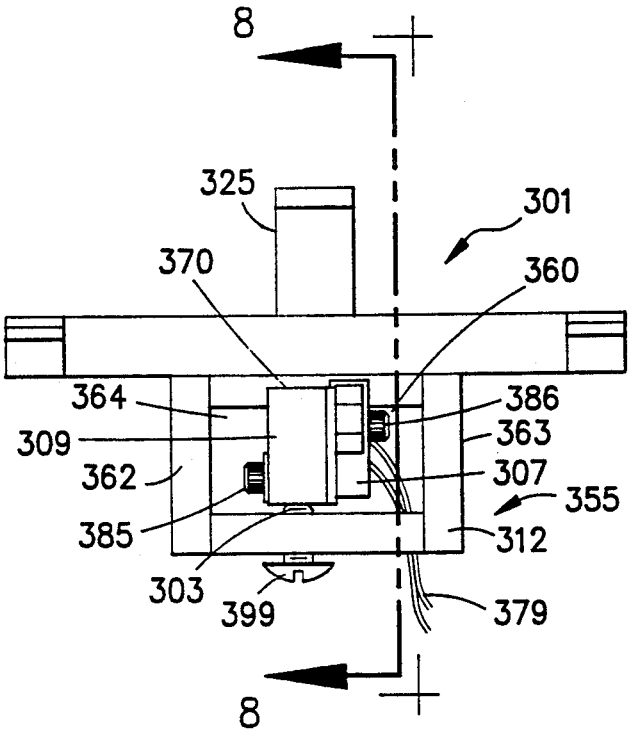
FIG. 6 is a fragmentary front plan view of an opto-electric position sensor for the deflector blade.

There is an adjustment mechanism for providing movement fore and aft substantially perpendicular to the longitudinal axis of the primary dye deflector blade 84 so that the primary dye deflector blade 84 can move toward and away from the dye passage outlets 52 that is generally indicated by numeral 242, as shown in FIG. 5. There is a threaded adjustment bracket 245 that is attached to the U-shaped channel member 214. There is a through-hole adjustment member 246 that is attached to rectangular adjustment arm 217. There is a threaded cap screw 248 that is positioned within through-hole adjustment member 246 with the head 249 of the threaded cap screw 248 positioned adjacent the through-hole adjustment member 246. The threaded cap screw 248 is, also, threadedly interconnected into the threaded adjustment bracket 245. The rectangular adjustment arm 217 is held in position by means of retaining collar 251 that is threadedly tightened against two Belleville®washers 253 and positioned against the through-hole adjustment bracket 246. After tightening the retaining collar 251 against the Belleville® washers 253, the retaining collar 251 is locked to the threaded cap screw 248 by means of an anaerobic adhesive such as Loctite® thread locking compound. Thus, when the cap screw 248 is turned in the threaded adjustment bracket 245, it causes the through hole adjustment member 246 and rectangular adjustment arm 217 to move so that the primary dye deflector blade 84 can move toward and away from the dye passage outlets 52.

It is desired that the primary dye deflector blade adjustment assembly apparatus 85 not protrude below the lower surface of the collector plate support member 86 to take up excess vertical space in case a cleaning shield is utilized like that disclosed in commonly assigned U.S. Pat. No. 4,993,242 issued Feb. 19, 1991, which is hereby incorporated by reference.

Referring now to FIGS. 3, 6, 7, 8 and 13, a means for determining the position of the primary dye deflector blade 84 is generally denoted by numeral 301. Since the primary dye deflector blade 84 is preferably constructed out of a thin strip of stainless steel (0.010"×1.25"), it is relatively easy to move. This means that any method of measuring the position of the primary dye deflector blade 84 that involves contact is likely to move the defector blade 84 and make the measurement meaningless. A miniature photocell/light source unit 305, such as an optical isolator, with an approximately linear response over a few thousandths of an inch of movement of an occluding body is used to sense the location of the edge of the primary dye deflector blade 84. This miniature photocell/light source unit 305 is preferably a HONEYWELL® HOA1875-2, however there are numerous approximately linear photocells in combination with a light source that may be used. The miniature photocell/light source unit 305 is mounted to the end of a rectangular first arm member 307 by means of a threaded hex-head bolt 386.

First arm member 307 is fixedly attached by means of a threaded hex-head bolt and washer 385 through a oval slot 387 into a U-shaped channel 375 in positioning block 309 that positions miniature photocell/light source unit 305 back and forth in relation to the primary dye deflector blade 84. The positioning block 309 is moved by means of adjustable screw 310 that is loaded by means of a spring 303. There is a set screw 399 that locks the positioning block 309 into one fixed position. The positioning block 309 is also located within a U-shaped channel 370 within the first side 360 of a five sided open rectangular box, generally indicated by numeral 355. The second side 361 or bottom of the rectangular box 355 is located opposite the first side 360 of the five sided open rectangular box 355 and has a threaded hole for a set screw 399. Adjacent the first side 360 and the second side 361 is the third side 362 and the fourth side 363 in opposed relationship. There is a first pair of recessed hex-head bolts 367, 368 respectively that attach fourth side 363 to second side 361 and an second pair of recessed hex-head bolts (not shown) that attach third side 362 to second side 361. The fifth side 364 provides a cover and is mounted adjacent to the first side 360, second side 361, third side 362 and fourth side 363 respectively. There are two pairs of recessed hex-head bolts (not shown) that attach the fifth side 364 to the third side 362 and the fourth side 363, respectively. There are wires 379 extending from the miniature photocell/light source unit 305 to a circuit board 330 through a hole (not shown) in the second side 361. Adjusting screw 310 passes through a clearance hole in side 364, through compression spring 303 and into a threaded hole in positioning block 309.

This means for determining the position of the primary dye deflector blade 301 can be formed out of any of a wide variety of materials including metals, plastics, composites, ceramics, and so forth.

Attached to the top of the five sided open rectangular box 355 is a sensor position locator 325 that keys against the rear corner of the grooved dye outlet module 50, as shown in FIG. 3. The grooved dye outlet module should be accurately machined for precision adjustment of the primary dye deflector blade 84. The sensor position locator 325 is attached by a series of four recessed hex-head bolts with two hex-head bolts 391, 392 attached to the third side 362 and the fourth side 363, respectively, and two inner hex-head bolts 393 and 394 that are attached to the fourth side 364 of the five sided open rectangular box 355. The miniature photocell/-light source unit 305 is held so that the edge of the primary dye deflector blade 84 is inside the miniature photocell/light source unit's 305 field of view.

Figure 13:
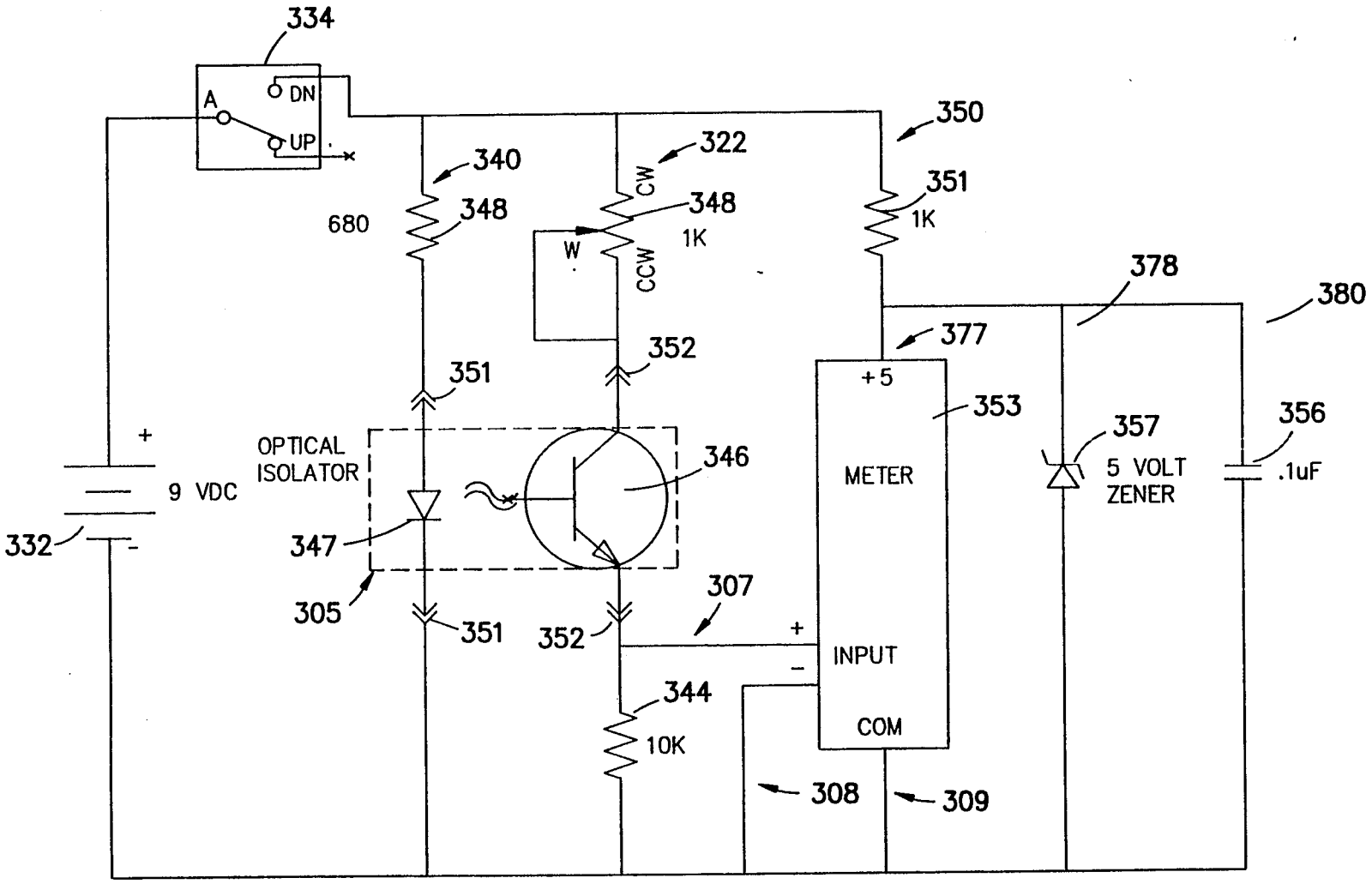
FIG. 13 is an electrical schematic diagram of the opto-electric blade position sensor.

As shown in FIGS. 3, 6, 7, and 8, the miniature photocell/light source unit 305 is electrically connected to the electrical components mounted on a circuit board 330. Circuit board 330 may optionally be attached to the five sided open rectangular box 355. Referring now to FIG. 13, the miniature photocell/light source unit 305 is powered by a nine (9) volt battery 332 that is connected and disconnected by means of a momentary on/off push button switch 334. The photocell/light source unit 305 is divided into a photocell 336 and the light source in the form of a light emitting diode 337. The first parallel path 340 allows 12.2 milliamperes to flow through a 680 ohm, ¼ watt, five percent (5%) precision resistor 348 and then through the light emitting diode 337 thereby causing activation thereof and then connecting with the negative terminal of the nine (9) volt battery 332. Two of the wires 379 extending from the light emitting diode 337 attached to the circuit board 330 by means of plug-in type connectors 351.

Figure 7:
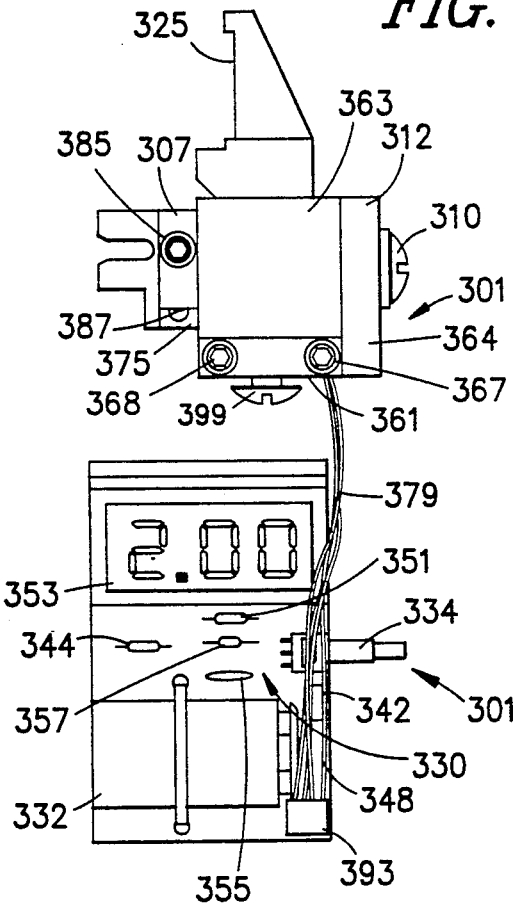
FIG. 7 is a fragmentary side view of an opto-electric position sensor for the deflector blade.
Figure 8:
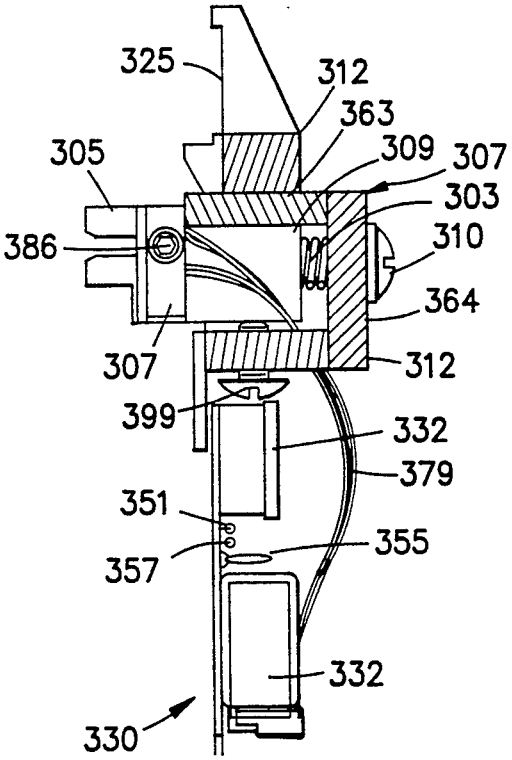
FIG. 8 is a sectional side elevational view taken on line 8—8 of FIG. 6.

The second parallel path 322 for current flow from the positive terminal of the nine (9) volt battery 332 allows current to flow through a 1,000 ohm potentiometer 342 then through the photocell 336 and finally through a 10,000 ohm, one-fourth (¼) watt, five percent (5%) precision resistor 344 and finally and back to the negative terminal of the nine (9) volt battery 332. Two of the wires 379 extending from the photocell 336 attached to the circuit board 330 by means of plug-in type connectors 352. The light emitting diode 337 must shine light on the photocell 336 in order for current to flow through the second parallel path 322. The first parallel path 340 allows 12.2 milliamperes to flow through a 680 ohm, ¼ watt, five percent (5%) precision resistor 348 and then through the light emitting diode 337 thereby causing activation thereof and then connecting with the negative terminal of the nine (9) volt battery 332. The third parallel path 350 allows 4 milliamperes to flow through a 1,000 ohm, ¼ watt, five percent (5%) precision resistor 351. After current passes through this resistor 351, it encounters three more parallel paths 377, 378, and 380, respectively, each containing one component connected to the negative terminal of the nine (9) volt battery 332. These three components consist of a five (5) digit liquid crystal display volt meter 353, a five (5) volt zener diode 357 and 0.1 microfarad capacitor 356, respectively. The zener diode 357 is for maintaining a constant five-volt supply to the liquid crystal display volt meter 353. The 0.1 microfarad capacitor 356 is for eliminating transient voltages from affecting the five (5) digit liquid crystal display volt meter 353. The liquid crystal display volt meter 353 measures voltage across the 10,000 ohm resistor 344 by means of a positive input path 307 connected between photocell 336 and the 10,000 ohm resistor 344. There is a negative input path 308 attached to the other side of the 10,000 ohm resistor 344 and the negative terminal of the nine (9) volt battery 332. There is also a common path 309 that is also connected to the negative terminal of the nine (9) volt battery 332. A non-limiting example of a digital voltmeter 353 is an ACCULEX® DP-650 with four digits and a minus sign on the liquid crystal display. There is a four-wire stick pin male header 393 for connecting the miniature photocell/light source unit 305 to the circuit board 330 by means of wires 379, as shown in FIG. 7. The circuit board 330 can be manufactured by any type of photo or chemical etching-type process. For convenience, the circuit board 330 may be enclosed within a box (not shown).

The optimum position of the primary dye deflector blade 84 is determined by the primary dye deflector blade adjustment assemblies 85 in which the end of the primary dye deflector blade 84 is moved toward the dye passage outlets 52 until the edge of the blade 84 contacts the stream from the dye passage outlets 52, as shown in FIG. 3. The first step is to adjust one end mount adjuster assembly 91, as shown in FIG. 10, by turning threaded bolt 95 or 96 to move the primary dye deflector blade 84 away from the stream emitting from the dye passage outlets 52. Next, the opto-electric blade position sensor 301 is positioned adjacent to the grooved dye outlet module 50 containing an end dye passage outlet and located by holding its reference surfaces against the mating surfaces of the grooved dye outlet module 50. While in this position, the position of the opto-electric blade position sensor 301 is adjusted so that the five (5) digit volt meter 353 is at mid range with the primary dye deflector 84 obstructing a portion of the light emitted from the light emitting diode 337. This adjustment of opto-electric blade position sensor 301 with respect to reference surfaces will be used at all other primary dye deflector blade adjustment assemblies 85 and the opposite end mount adjuster assembly 91 to locate the proper primary dye deflector blade 84 position. As shown by FIG. 14, there is a substantially linear relationship between the voltage readout between zero to eight volts and the deflector blade position between zero and 0.035 inches.

As previously stated, deflector blade adjustment assembly apparatus 85 includes a rectangular adjuster arm 217 having a retaining clip 219 attached at one end by means of rivets 221. The retaining clip 219 holds the primary dye deflector blade 84 in place to prevent vibration. The rectangular adjustment arm 217 is held in position by means of a U-shaped channel member 214 on each side for movement of the entire rectangular adjuster arm 217. The U-shaped channel member 214 is attached to the collector plate support member 86. There is a threaded adjustment bracket 245 that is attached to the U-shaped channel member 214. There is a through-hole adjustment member 246 that is attached to rectangular adjustment arm 217. There is a threaded cap screw 248 that is positioned within through-hole adjustment member 246 with the head 249 of the threaded cap screw 248 positioned adjacent the through-hole adjustment member 246. The threaded cap screw 248 is, also, threadedly interconnected into the threaded adjustment bracket 245. The rectangular adjustment arm 217 is held in position by means of retaining collar 251 that is threadedly tightened against two Belleville® washers 253 and positioned against the through-hole adjustment member 246. After tightening the retaining collar 251 against the Belleville® washers 253, the retaining collar 251 is locked to the threaded cap screw 248 by means of an anaerobic adhesive such as Loctite® thread locking compound. Thus, when the cap screw 248 is turned in the threaded adjustment bracket 245, it causes the through hole adjustment member 246 and rectangular adjustment arm 217 to move so that the primary dye deflector blade 84 can move toward and away from the dye passage outlets 52.

Then the opto-electric blade position sensor 301 is held against the grooved dye outlet module 50 and the digital voltage value is read from the five (5) digit digital voltmeter 353. The primary dye deflector blade 84 is moved by means of moving the retaining collar 251 back and forth along threaded cap screw 248 so that the primary dye deflector blade 84 can move toward and away from the dye passage outlets 52 causing the same numerical voltage value as that found at the end mount adjuster assembly 90. This same procedure is used for all the remaining intermediate primary dye deflector blade adjustment assemblies 85 and the remaining end mount adjuster assembly 91. Because moving one rectangular adjuster arm 217 can affect a neighboring primary dye deflector blade adjustment assembly 85, the primary dye deflector blade 84 position should be rechecked and re-adjusted if necessary. Please note that the air deflector tubes 62 will need to be disconnected and moved out of the way in order to utilize the opto-electric blade position sensor 301. In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

What is claimed is:

1. An apparatus for applying liquids to a moving substrate comprising means for conveying the substrate in a predetermined path of travel, liquid applicator means having a row of outlets extending across and positioned above the substrate path for discharging a corresponding row of generally parallel, undeflected primary streams of liquid on a trajectory directed toward the substrate path, a source of electrically encoded pattern data, gas passage means positioned adjacent to said row of outlets and aligned with the discharge axes of the outlets for selectively deflecting, in accordance with pattern data from such data source, the trajectory of said primary streams of liquid emerging from said outlets with streams of gas from said gas passage means which intersect said primary streams of liquid, a liquid collection chamber positioned adjacent to said outlets and opposite from said gas passage means, said liquid collection chamber having an opening which extends along said row of outlets and which is positioned to receive said gas streams and primary liquid streams deflected by said gas streams and thereby prevent said streams from contacting said substrate, a liquid deflector blade having a longitudinal axis and supportably positioned in said opening with an outer edge of said liquid deflector blade extending along the opening and positioned closely adjacent said row of outlets to intercept and direct deflected liquid into the collection chamber and a means for precisely measuring the position of said liquid deflector blade in relation to said opening so that said liquid deflector blade may be adjusted along said longitudinal axis.

2. The apparatus of claim 1, wherein said means for precisely measuring the position of said liquid deflector blade in relation to said opening further comprises of an opto-electric sensor.

3. The apparatus of claim 2, wherein said opto-electric sensor includes a means for projecting a beam of light against said liquid deflector blade, a photoelectric detector for receiving said beam of light and for generating an output signal which varies as the amount of light received by said detector and a means for measuring said output signal that substantially relates to the amount of liquid deflector blade blocking said photoelectric detector.

4. The apparatus of claim 3, wherein said means for measuring said output signal includes a voltmeter.

5. The apparatus of claim 4, further comprising of a means for applying voltage to said voltmeter.

6. The apparatus of claim 5, further comprising of a means for regulating voltage applied to said voltmeter.

7. The apparatus of claim 6, wherein said means for regulating voltage applied to said voltmeter further includes a zener diode.

8. The apparatus of claim 6, wherein said means for regulating voltage applied to said voltmeter further includes a capacitor.

9. The apparatus of claim 3, wherein said means for projecting a beam of light includes a light emitting diode.

10. The apparatus of claim 3, wherein said photoelectric detector for receiving said beam of light and for generating an output signal includes a photocell.

11. A process for applying liquids to a moving substrate comprising the steps of conveying the substrate in a predetermined path of travel, applying a row of generally parallel undeflected primary streams of liquid on a trajectory directed toward the substrate path, selectively deflecting said primary streams of liquid in accordance with patterned data with emerging stream of gas which intersect with primary streams of liquid, deflecting said gas streams and primary liquid streams off of a liquid deflector blade into a liquid collection chamber and measuring a position of said liquid deflector blade so that said liquid deflector may be located to precisely deflect said gas streams and primary liquid streams away from said substrate.

12. A process for applying liquids to a moving substrate comprising the steps of conveying the substrate in a predetermined path of travel, applying a row of generally parallel undeflected primary streams of liquid on a trajectory directed toward the substrate path, selectively deflecting said primary streams of liquid in accordance with patterned data with emerging streams of gas which intersect said primary streams of liquid, deflecting said gas streams and primary liquid streams off of a liquid deflector blade into a liquid collection chamber and measuring a position of said liquid deflector blade to precisely deflect said gas streams and primary liquid streams away from said substrate with an opto-electric sensor.

13. A process for applying liquids to a moving substrate comprising the steps of conveying the substrate in a predetermined path of travel, applying a row of generally parallel undeflected primary streams of liquid on a trajectory directed toward the substrate path, selectively deflecting said primary streams of liquid in accordance with patterned data with emerging streams of gas which intersect said primary streams of liquid, deflecting said gas streams and primary liquid streams off of a liquid deflector blade into a liquid collection chamber and measuring a position of said liquid deflector blade to precisely deflect said gas streams and primary liquid streams away from said substrate with an opto-electric sensor which includes a means for projecting a beam of light against said liquid deflector blade, a photoelectric detector for receiving said beam of light and for generating an output signal which varies as the amount of light received by said detector and a means for measuring said output signal that substantially relates to the amount of liquid deflector blade blocking said photoelectric detector.

14. A process for applying liquids to a moving substrate comprising the steps of conveying the substrate in a predetermined path of travel, applying a row of generally parallel undeflected primary streams of liquid on a trajectory directed toward the substrate path, selectively deflecting said primary streams of liquid in accordance with patterned data with emerging streams of gas which intersect said primary streams of liquid, deflecting said gas streams and primary liquid streams off of a liquid deflector blade into a liquid collection chamber and measuring a position of said liquid deflector blade to precisely deflect said gas streams and primary liquid streams away from said substrate with an opto-electric sensor which includes a means for projecting a beam of light against said liquid deflector blade, a photoelectric detector for receiving said beam of light and for generating an output signal which varies as the amount of light received by said detector and a voltmeter for measuring said output signal that substantially relates to the amount of liquid deflector blade blocking said photoelectric detector.

15. A process for applying liquids to a moving substrate comprising the steps of conveying the substrate in a predetermined path of travel, applying a row of generally parallel undeflected primary streams of liquid on atrajectory directed toward the substrate path, selectively deflecting said primary streams of liquid in accordance with patterned data with emerging streams of gas which intersect said primary streams of liquid, deflecting said gas streams and primary liquid streams off of a liquid deflector blade into a liquid collection chamber and measuring a position of said liquid deflector blade to precisely deflect said gas streams and primary liquid streams away from said substrate with an opto-electric sensor which includes a light emitting diode for projecting a beam of light against said liquid deflector blade, a photoelectric detector for receiving said beam of light and for generating an output signal which varies as the amount of light received by said detector and a voltmeter for measuring said output signal that substantially relates to the amount of liquid deflector blade blocking said photoelectric detector.

16. A process for applying liquids to a moving substrate comprising the steps of conveying the substrate in a predetermined path of travel, applying a row of generally parallel undeflected primary streams of liquid on a trajectory directed toward the substrate path, selectively deflecting said primary streams of liquid in accordance with patterned data with emerging streams of gas which intersect said primary streams of liquid, deflecting said gas streams and primary liquid streams off of a liquid deflector blade into a liquid collector chamber and measuring a position of said liquid deflector blade to precisely deflect said gas streams and primary liquid streams away from said substrate with an opto-electric sensor which includes a light emitting diode for projecting a beam of light against said liquid deflector blade, a photocell for receiving said beam of light and for generating an output signal which varies as the amount of light received by said detector and a voltmeter for measuring said output signal that substantially relates to the amount of liquid deflector blade blocking said photoelectric detector.

* * * * *